United States Patent [19]

Mori et al.

[11] 4,258,516

[45] Mar. 31, 1981

[54] APPARATUS FOR SUPPORTING FLOOR PLATES ABOVE SUBSTRATE

[75] Inventors: Osamu Mori, Yokohama; Takanao Yoshizawa, Chigasaki; Kozo Samata, Yokohama, all of Japan

[73] Assignee: Bridgestone Tire Company Limited, Tokyo, Japan

[21] Appl. No.: 28,945

[22] Filed: Apr. 11, 1979

[30] Foreign Application Priority Data

| | | | |
|---|---|---|---|
| Jun. 16, 1978 | [JP] | Japan | 53-72779 |
| Oct. 16, 1978 | [JP] | Japan | 53-140777[U] |
| Dec. 12, 1978 | [JP] | Japan | 53-152668 |
| Jan. 30, 1979 | [JP] | Japan | 54-10323[U] |

[51] Int. Cl.[3] ..... E02D 27/34

[52] U.S. Cl. ..... 52/126; 52/167

[58] Field of Search ..... 52/126, 122, 167; 248/188.4, 650

[56] References Cited

U.S. PATENT DOCUMENTS

| | | | |
|---|---|---|---|
| 2,678,823 | 5/1954 | Hagman | 52/126 |
| 3,351,309 | 11/1967 | Harrison | 248/650 |
| 3,511,001 | 5/1970 | Morgan | 52/126 |
| 3,638,377 | 2/1972 | Caspe | 52/167 |
| 3,899,857 | 8/1975 | Mochizaki | 52/126 |

FOREIGN PATENT DOCUMENTS

| | | | |
|---|---|---|---|
| 1008897 | 5/1967 | Fed. Rep. of Germany | 52/122 |
| 1454115 | 9/1966 | France | 52/126 |
| 2098546 | 7/1974 | France | 52/126 |
| 217322 | 11/1967 | Sweden | 248/650 |

*Primary Examiner*—James A. Leppink
*Assistant Examiner*—H. E. Raduazo
*Attorney, Agent, or Firm*—Sughrue, Rothwell, Mion, Zinn and Macpeak

[57] ABSTRACT

Apparatus for supporting floor plates above substrate comprising a supporting rod threadedly engaged with an upper female screw threaded sleeve fitted in a hole provided at a corner of the floor plate and threadedly engaged with a lower female screw threaded sleeve fitted in a center hole of a cylindrical rubber-like elastic body disposed on the substrate, said supporting rod being provided at its upper end with a slot adapted to be engaged with a driving tool and the upper threads of said supporting rod being oppositely handed to the lower threads thereof.

1 Claim, 19 Drawing Figures

FIG_1A
PRIOR ART
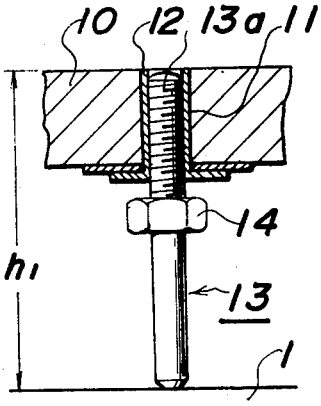
FIG_1B
PRIOR ART
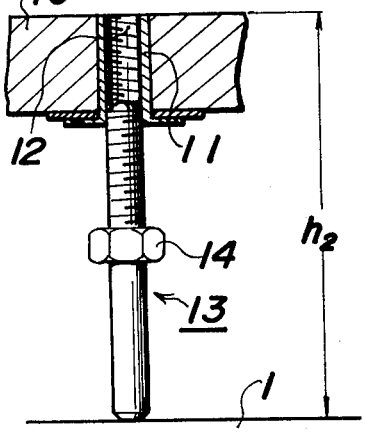
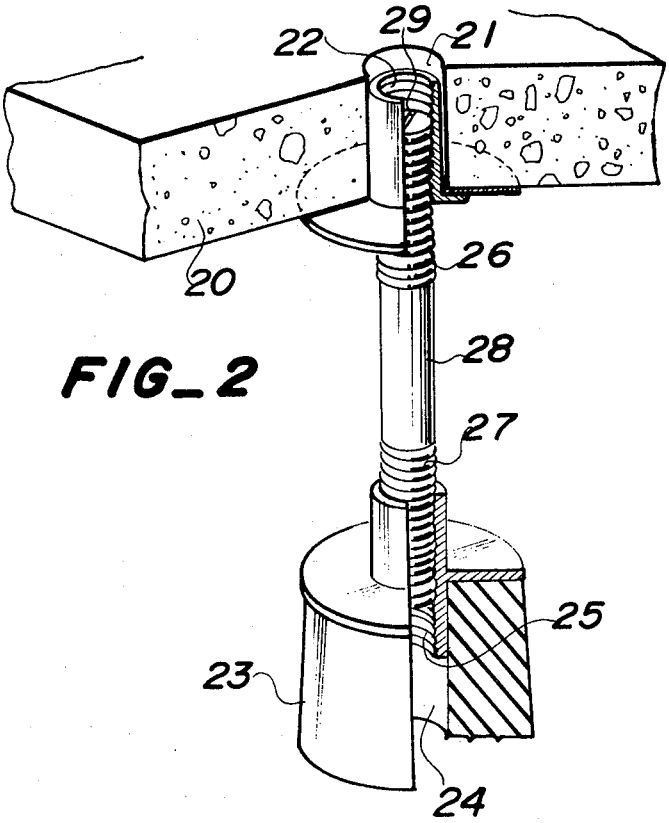
FIG_2

APPARATUS FOR SUPPORTING FLOOR PLATES ABOVE SUBSTRATE

BACKGROUND OF THE INVENTION

1. Field of the Invention

This invention relates to an apparatus for supporting floor plates above a substrate, which are adapted for use in a floor framework construction for a reinforced concrete residential building, gymnasium or the like and adjustable for a wide range between the upper and lower heights and for a horizontal level in an easy manner.

2. Description of the Prior Art

Heretofore, it has been proposed to provide a floor framework construction for buildings comprising a substrate formed of mortar, a base plate mounted on the substrate and a floor plate secured to the base plate by means of a bolt and nut. In such conventional floor framework construction, the base plate must be replaced by a new one every time the floor plate is adjusted to a horizontal level and in height. As a result, such conventional floor framework construction is troublesome in assembling operation and has been encountered with various problems with respect to the other points.

Recently, in order to spread the floor plates at a height suitably distant apart from the substrate, provision has been made of an apparatus for supporting floor plates comprising a floor plate provided with a hole, a female screw threaded sleeve fitted in the hole of the floor plate and a supporting leg composed of a screw threaded rod threadedly engaged with the sleeve and supported by the substrate. The threaded rod is provided at its center with a nut-shaped member. In this case, the threaded rod is rotated by rotating the nut-shaped member by means of a driving tool such as a wrench so as to adjustably raise or lower the floor plate.

Such conventional apparatus for supporting the floor plates can eliminate the above mentioned drawback to certain extent, but still has the disadvantage that the nut-shaped member located below the floor plate must be rotated in order to adjust the upper and lower heights of the floor plate. The use of such nut-shaped member of the threaded rod has the disadvantage that the rotation thereof is inconvenient, that the adjustable range of the floor plate becomes narrow, that the adjusting operation is slow is speed and that trouble arises in operation of the apparatus as a whole.

SUMMARY OF THE INVENTION

An object of the invention, therefore, is to provide an apparatus for supporting floor plates above a substrate, which can eliminate the above mentioned drawbacks which have been encountered with the prior art techniques, i.e. which not only can simplify the adjusting operation of the floor plate but also can widen an adjustable range between the upper and lower heights of the floor plate, and which can significantly improve the workability such as adjusting speed of the floor plate or the like.

A feature of the invention is the provision of an apparatus for supporting floor plates above a substrate, comprising a flat square floor plate provided at least at each corner thereof with a hole, an upper female screw threaded sleeve fitted in said hole of said floor plate, a cylindrical rubber-like elastic body having a center hole and disposed on the substrate, a lower female screw threaded sleeve fitted in said center hole of said cylindrical rubber-like elastic body and having threads oppositely-handed to those of said upper female screw threaded sleeve, a supporting rod composed of a screw threaded rod provided at its upper and lower portion with right-handed and left-handed screw threads and at its upper end with a slot adapted to be engaged with and rotated by a driving tool, said right-handed and left-handed screw threads of said threaded rod being threadedly engaged with said upper and lower female screw threads of said upper and lower female screw threaded sleeves, respectively.

In using the apparatus of the invention a shock absorbing member is secured to the end edge of a floor plate provided at least at each corner thereof with a supporting leg composed of a threaded rod and provided at its upper end with a slot, the height of said floor plate is adjusted by rotating said supporting leg by means of a driving tool engaged with said slot of said supporting leg, adjacent end edges of said floor plates are abutted against each other through said shock absorbing members so as to spread said floor plates all over the substrate, and the level of said floor plates is adjusted to a common horizontal level.

Furhter objects and features of the invention will be fully understood from the following detailed description with reference to the accompanying drawings, in which:

BRIEF DESCRIPTION OF THE DRAWINGS

FIG. 1 is a cross-sectional view of a conventional apparatus for supporting floor plates above a substrate showing a floor plate at its lowered position;

FIG. 1*b* is a similar cross-sectional view showing a floor plate at its raised position;

FIG. 2 is a perspective view of one embodiment of an apparatus for supporting floor plates above a substrate according to the invention, partly shown in section;

DETAILED DESCRIPTION OF THE PREFERRED EMBODIMENTS

Figure 3:
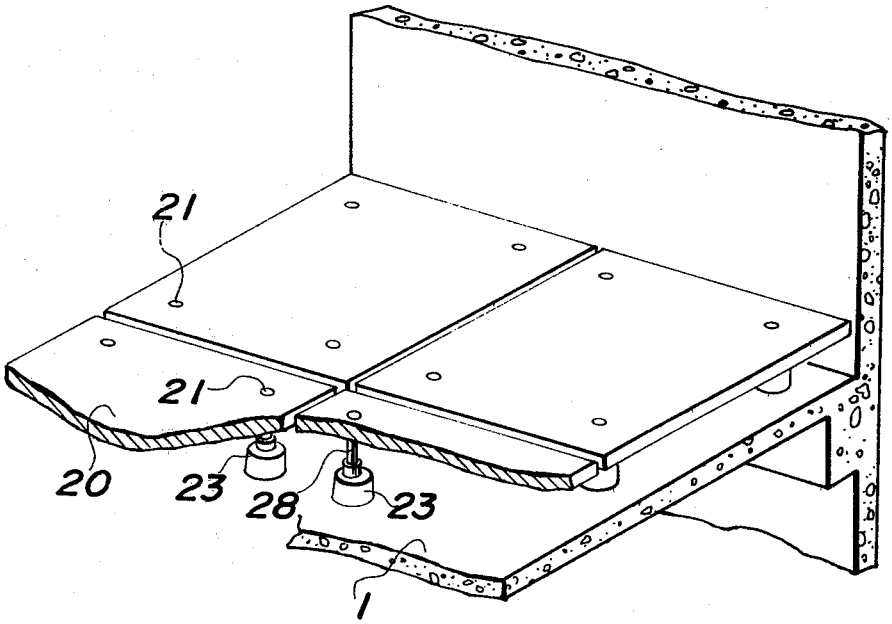
FIG. 3 is a perspective view illustrating the supporting of floor plates above a substrate according to the invention.

As described above, in this invention the floor plates may be arranged side by side without any gap remained therebetween or may be distant apart from each other with a suitable gap remained therebetween. In the former method, the adjacent floor plates are abutted against with each other through the shock absorbing members secured to the end edge of the floor plate and sandwiched therebetween. In the latter method, the adjacent floor plates are distant apart from each other with the suitable gap remained therebetween and a connection sheet is disposed on and made integral with the surface of the floor plates after these floor plates have been adjusted in level by rotating the supporting legs.

The floor plate may be composed of one flat plate, at least two veneer boards or synthetic plate composed of particle board or the like. Alternatively, the floor plate may be composed of laminated plates with a thin elastic layer sandwiched therebetween. The thin elastic layer may be formed of a rubber-like elastic material such as butadiene acrylonitrile rubber, polyisobutylene rubber, ethylene-propylene rubber or may be formed of a rubber composition formed of the above mentioned rubber-like elastic material blended with polyvinyl chloride, polybutene, inorganic filler and having an internal attenuation ability. In this case, it is possible to significantly improve the soundproof and oscillation-proof ability. The thin elastic layer has a thickness on the order of 0.5 to 1 mm.

As means for improving the sound-proof and oscillation-proof ability, it is preferable to interpose a rubber-like elastic body between the floor plate and the upper female screw threaded sleeve. The rubber-like elastic body is composed of an annular body having a center hole extending therethrough. In the center hole is fitted the upper female screw threaded sleeve concentrically arranged with the hole provided in the floor plate. As a result, the floor plate does not directly make contact with the threaded rod, but the rubber-like elastic body is interposed therebetween.

On the one hand the threaded rod does not also directly make contact with the substrate, but the cylindrical rubber-like elastic body is interposed therebetween. As a result, the shock sound, oscillations or the like produced when the floor plate is subjected to the load can considerably be attenuated by means of the two rubber-like elastic bodies. In this case, if use is made of the floor plate composed of the laminated plates with the thin elastic layer sandwiched therebetween, it is possible to improve the above mentioned attenuation ability.

The apparatus according to the invention mainly tends to cause the cylindrical rubber-like elastic body to be elastically deformed and hence to absorb the shock produced on the floor plate and prevent the shock from being propagated toward the substrate. That portion of the floor plate which is located at the entrance or the like of a room is downwardly depressed with respect to the fixed surface of the entrance, etc. An embodiment of eliminating such disadvantage will be described later.

FIG. 1*a* shows a conventional apparatus for supporting floor plates above a substrate. In such conventional apparatus, a floor plate 10 is provided with a hole 11 in which is firmly fitted a female screw threaded sleeve 12. A supporting rod composed of a screw threaded rod 13 is provided at its head portion 13*a* with threads threadedly engaged with those of the sleeve 12. The threaded rod 13 is provided at its center portion with a nut-shaped member 14 secured thereto. If the nut-shaped member 14 is rotated by a driving tool such as a wrench or the like, it is possible to raise the floor plate 10 to an upper position shown in FIG. 1*b* and then lower it to a lower position shown in FIG. 1*a*.

FIG. 2 shows one embodiment of an apparatus for supporting floor plates above a substrate according to the invention. Referring to FIG. 2, a flat square floor plate 20 provided at least at each corner thereof with a hole 21 in which is firmly fitted an upper female screw threaded sleeve 22. On a substrate (not shown) is disposed a cylindrical rubber-like elastic body 23 which is provided with a center bore 24 in which is firmly fitted a lower female screw threaded sleeve 25. The upper and lower female screw threaded sleeves 22, 25 are of left-handed and right-handed ones and threadedly engaged with right-handed and left-handed upper and lower male screw threads 26, 27 provided on the upper and lower portions of a screw threaded rod 28. The threaded rod 28 is provided at its upper end with a slot 29 adapted to be engaged with a driving tool such as a driver or the like (not shown). The driver is inserted into the hole 21 and brought into engagement with the slot 29. The rotation of the driver in clockwise or counterclockwise direction results in adjustment in height of the floor plate 20.

The slot 29 provided at the upper end of the threaded rod 29 may be of cross-shaped one instead of straight line-shaped one. Alternatively, use may be made of a many sided slot adapted to be engaged with a polygonal wrench. Conversely, the upper end of the threaded rod 28 may be polygonal adapted to be engaged with a corresponding polygonal hole of the driving tool.

FIG. 3 shows floor plates 20 arranged side by side above a substrate 1. Each of these floor plates 20 is adjusted in height with respect to the substrate 1 by inserting a driver or the like into a hole 21 and rotating a threaded rod 28 in clockwise or counterclockwise direction.

Figure 4:
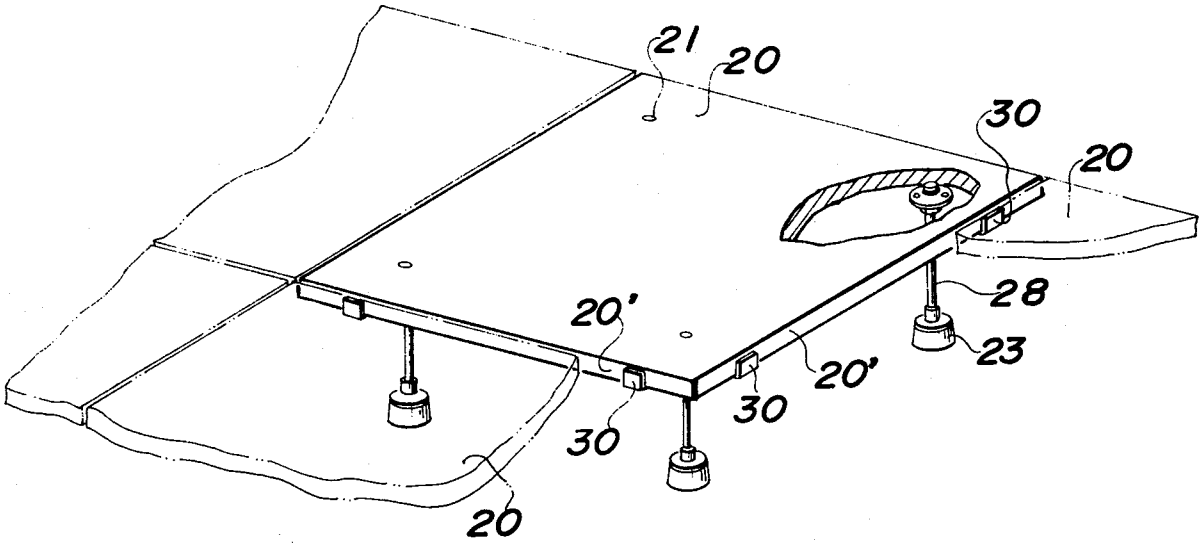
FIG. 4 is a perspective view of one embodiment of supporting floor plates above a substrate according to the invention.

FIG. 4 shows one embodiment of supporting floor plates 20 above a substrate 1 according to the invention. In the present embodiment, each floor plate 20 is provided at its end edge 20' with shock absorbing members 30. The end edge 20' of each floor plate 20 is opposed to the end edge 20' of adjacent floor plate 20 with the shock absorbing members 30 sandwiched therebetween. As a result, even when one of the floor plates 20 is subjected to the load and depressed downwardly with respect to the adjacent floor plate 20, there is no risk of a creak sound being produced by friction between the two adjacent floor plates 20, 20.

Figure 5A:
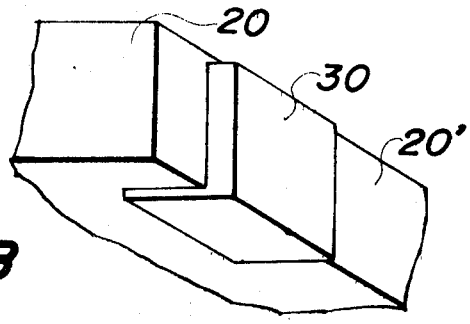
FIGS. 5*a* to 5*g* are perspective views of various types of shock absorbing members each adapted to be secured to an end edge of a floor plate.
Figure 5B:
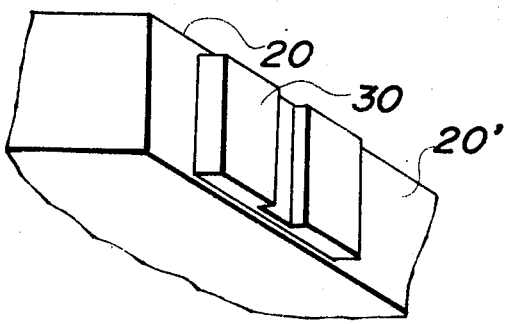
Figure 5C:
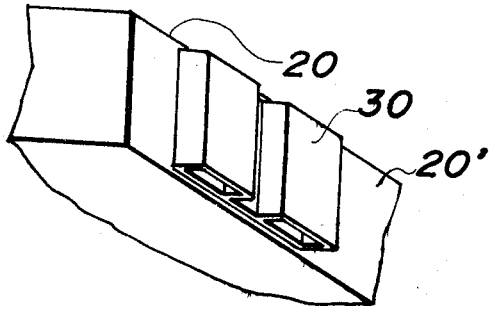
Figure 5D:
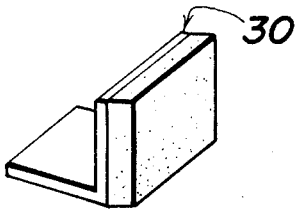
Figure 5E:
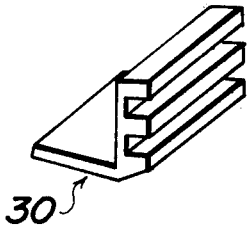
Figure 5F:
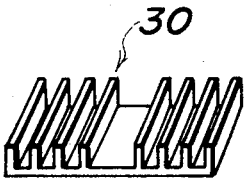
Figure 5G:
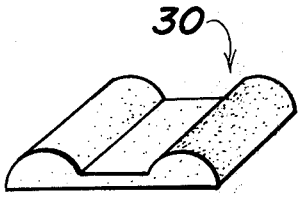

FIGS. 5*a* to 5*g* show various types of shock absorbing members 30 which may be formed of rubber or a synthetic resin such as polyvinyl chloride, polyurethane foam or the like. FIG. 5*a* shows one type of the shock absorbing member 30 which is composed of an angle-shaped piece whose one side facing the end edge of the adjacent floor plate is made large in thickness for the purpose of improving the shock absorbing property thereof. FIG. 5*b* shows another type of the shock absorbing member 30 which is composed of a rectangular piece including two box-shaped projections distant apart from and connected with each other by an intermediate thin piece. FIG. 5*c* shows a further type of the shock absorbing member 30 which is composed of a rectangular piece including two hollow box-shaped projections distant apart from and connected with each other by an intermediate thin piece. FIG. 5*d* shows a still further type of the shock absorbing member 30 which is composed of an angle-shaped piece whose one side facing the end edge of the adjacent floor plate is provided at its outer surface with an additional polyurethane foam piece. FIG. 5*e* shows another embodiment of the shock absorbing member 30 which is composed of an angle-shaped piece whose one side facing the end edge of the adjacent floor supporting plate is provided at its outer surface with a combteeth-shaped projections. FIG. 5*f* shows another embodiment of the shock absorbing member 30 which is composed of a rectangular piece provided at its one side facing the opposed end edge of the adjacent floor plate with two combteeth-shaped regions distant apart from and connected with each other by an intermediate thin piece. FIG. 5*g* shows another embodiment of the shock absorbing member 30 which is composed of a rectangular piece formed of polyurethane foam and provided at its one side facing the opposed end edge of the adjacent floor plate with two semicircular ridges distant apart from and connected with each other by an intermediate thin piece.

Figure 6:
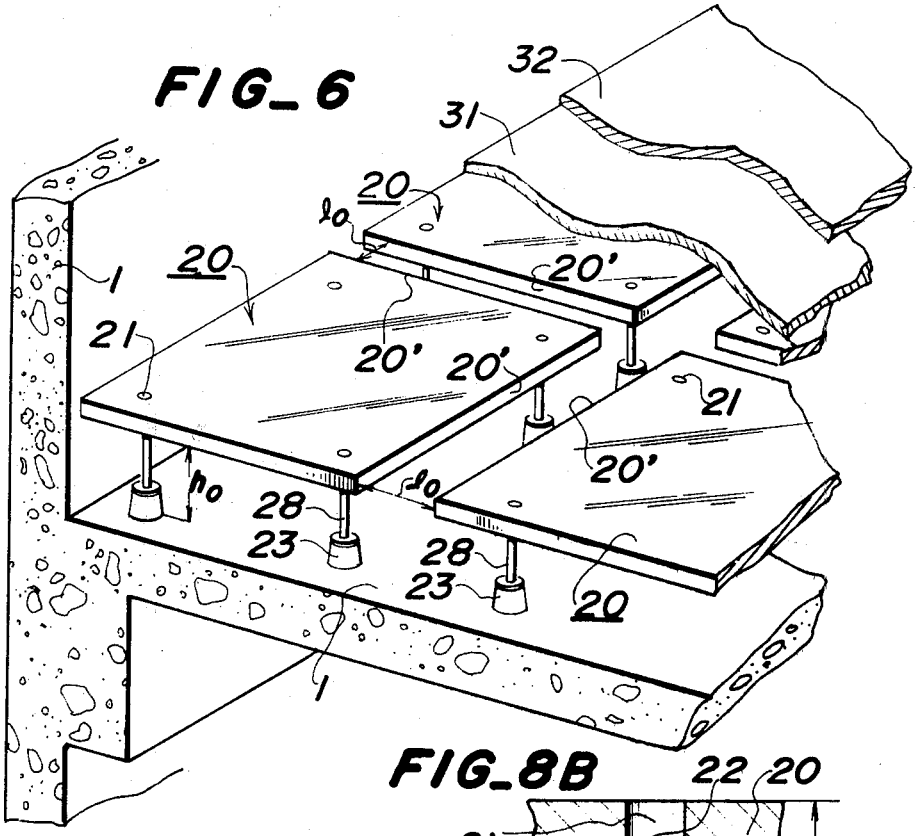
FIG. 6 is a perspective view of another embodiment of supporting floor plates above a substrate according to the invention.

FIG. 6 shows another embodiment of supporting floor plates above a substrate 1. In the present embodiment, all of the floor plates 20 are separated from each other by a suitable distance $l_o$ without making the end edges 20', 20' of adjacent floor plates 20, 20 contact with each other. In the case of supporting these floor plates 20 above the substrate 1, in the first place, all of the floor plates 20 are arranged side by side with adjacent end edges 20', 20' spaced apart from each other by a given distance $l_o$ and then the surface height $h_o$ of all of the floor plates 20 from the substrate 1 is adjusted by rotating a threaded rod 28 by means of a driver engaged with the top slot of the threaded rod. Subsequently, a plate-shaped connection sheet 31 is spread over the surface of the floor plates 20, 20 and secured to the latter by means of a wooden screw, cementing agent or the like. On the plate-shaped connection sheet 31 may be disposed a finish cover 32, if necessary.

The method described above with reference to FIG. 6 is capable of eliminating production of the above mentioned creak sound by suitably separating adjacent floor supporting plates one from the other by taking the strength of the floor material and the construction site where the floor plates can be set in place into consideration, and by firmly securing the floor plates to the connection sheet, thereby making the floor plates small in number and making the floor framework construction less expensive. In addition, even when a marginal space is left after the floor plates 20 have been spread all over the substrate 1, the above mentioned method can easily be applied.

Figure 7:
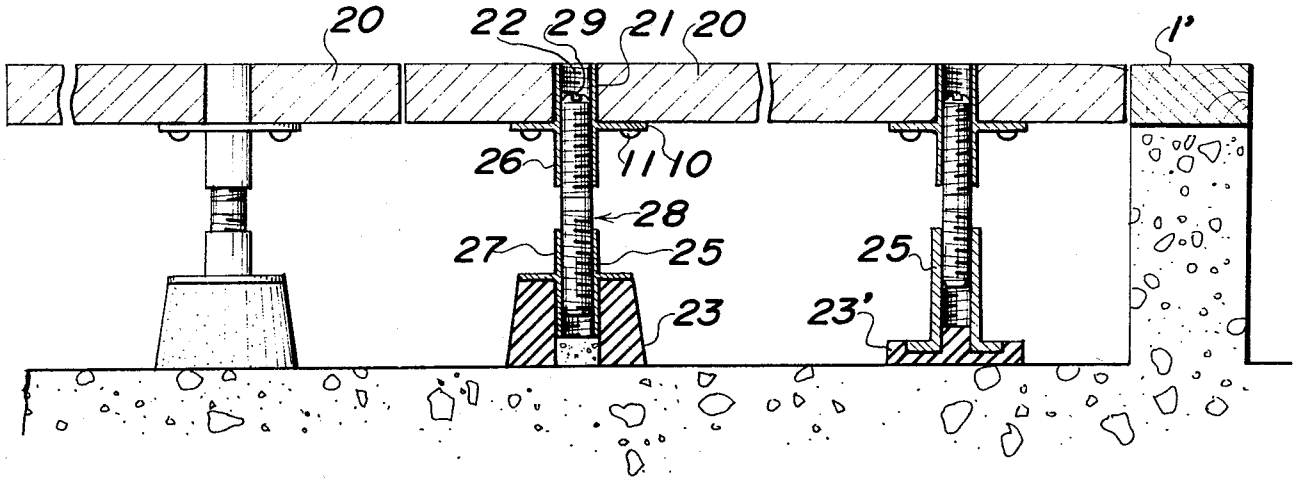
FIG. 7 is a cross-sectional view of another embodiment of an apparatus for supporting floor plates above a substrate according to the invention.

FIG. 7 shows another embodiment of an apparatus for supporting floor plates above a substrate according to the invention. In the present embodiment, the cylindrical rubber-like elastic body 23 formed of foamed synthetic resin or rubber shown at the left side of FIG. 7 is replaced by a disc-shaped rubber-like elastic body 23' shown at the right side of FIG. 7. As shown in FIG. 7, the present embodiment provided at its lower portion with the disc-shaped rubber-like elastic body 23' is applicable to that portion of the floor plate 20 which lies adjacent to a threshold 1' of a room or the like and which tends to be depressed downwardly. If this portion of the floor plate 20 is subjected to the load, the disc-shaped rubber-like elastic body 23' becomes less deformed, so that there is no risk of the above mentioned portion being depressed downwardly.

As described above, the apparatus for supporting floor plates above the substrate, comprises the threaded rod 28 provided at its upper portion with the right-handed screw threads 26 and at its lower portion with the left-handed screw threads 27. The use of such threaded rod 28 can raise and lower the floor plate 20 with respect to substrate 1 everytime the threaded rod 28 is turned at a speed which is two times faster than that of a prior art apparatus, thereby significantly shortening the operating time. In addition, the apparatus according to the invention can raise and lower the floor plate 20 within an adjustable range which is considerably wider than that of the conventional apparatus. Moreover, the apparatus according to the invention can adjustably raise and lower the floor plate 20 by inserting the driving tool such as the driver or the like into the hole 21 and engaging it with the slot 29 provided on the upper end of the threaded rod 28 after the floor plates 20 have been spread all over the substrate 1, the adjusting operation being carried out while watching the level of all of the floor plates 20.

On the contrary, in the conventional apparatus shown in FIG. 1, the nut-shaped member 14 located below the floor plate 10 and firmly secured to the threaded rod 13 is rotated by means of the wrench engaged with the nut-shaped member 14 for the purpose of adjustably raising and lowering the floor plate 10. As a result, it is impossible to adjustably raise and lower the floor plate 10 after the floor plates have been spread all over the substrate 1. That is, the floor plate 10 must be spread over the substrate 1 while adjusting its level one by one, thereby rendering the operations very troublesome.

Figure 8B:
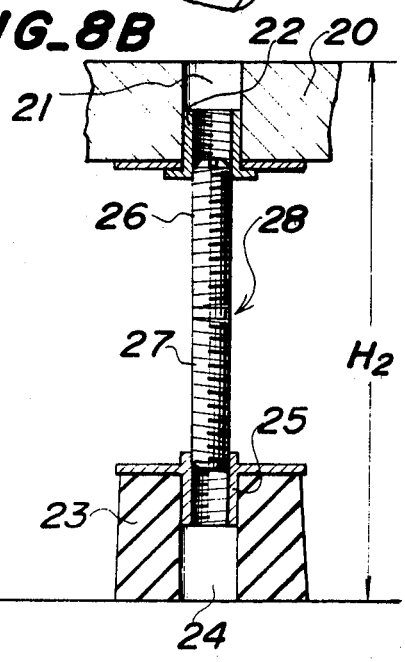
FIG. 8*b* is a similar cross-sectional view showing a floor plate at its raised position.
Figure 8A:
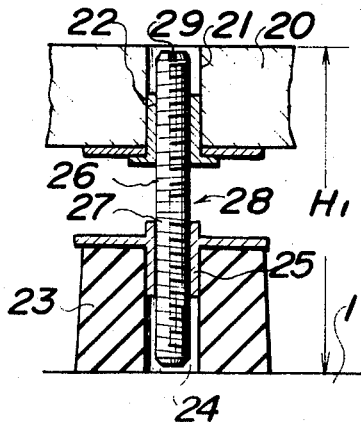
FIG. 8*a* is a cross-sectional view of the apparatus according to the invention shown in FIG. 2 showing a floor plate at its lowered position.

The adjusting ability of the apparatus according to the invention shown in FIG. 8 will now be compared with that of the conventional apparatus shown in FIG. 1. Let it be assumed that the floor plates 10, 20 are the same in material and dimension, that the threaded rods 13, 28 are the same in length and diameter, and that the threaded rod 13 is provided with the right-handed screw threads as shown in FIG. 1 while the threaded rod 28 is provided at its upper and lower portions with the right-handed and left-handed screw threads 26, 27, respectively, as shown in FIG. 8. As can be seen from FIGS. 1*a* and 8*a*, both the apparatuses can adjust the floor plates 10, 20 to the lowest positions thereof, respectively, respective heights $h_1$ and $H_1$ being substantially the same with each other, that is, $H_1 \simeq h_1$.

On the contrary, as can be seen from FIGS. 1*b* and 8*b*, if the floor plates 10, 20 are adjusted to the highest positions thereof, respectively, a height $H_2$ of the floor plate 20 obtained by the apparatus according to the invention is considerably higher than a height $h_2$ of the floor plate 10 obtained by the conventional apparatus that is, $H_2 > h_2$. The difference between the adjusted heights obtained by the apparatus according to the invention $(H_2 - H_1)$ is substantially two times larger than the difference between the adjusted heights obtained by the conventional apparatus $(h_2 - h_1)$, that is $(H_2 - H_1) = 2(h_2 - h_1)$. As seen from the above, the apparatus according to the invention is far superior in adjusting ability to the conventional apparatus.

Figure 9:
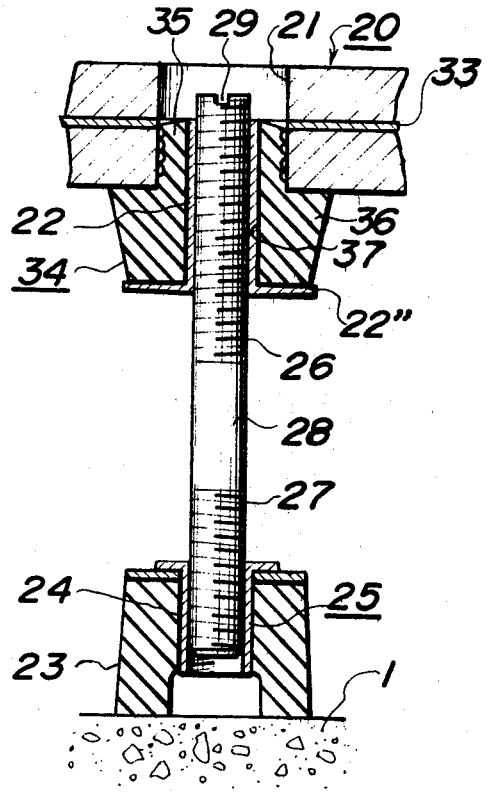
FIG. 9 is a cross-sectional view of a further embodiment of apparatus for supporting floor plates above a substrate according to the invention.

FIG. 9 shows a further embodiment of an apparatus according to the invention. In the present embodiment, the floor plate 20 is composed of two layers with an elastic sheet 33 formed of polyisobutylene rubber ot the like sandwiched therebetween and between the floor plate 20 and the upper female screw threaded sleeve 22 is inserted an annular rubber-like elastic body 34. The annular rubber-like elastic body 34 is composed of an upper reduced diameter portion 35 fitted in the hole 21 provided in the floor plate 20 and a lower large diameter portion 36 for supporting the floor plate 20. The annular rubber-like elastic body 34 is provided with a central hole 37 extending therethrough. In the central hole 37 is fitted the upper female screw threaded sleeve 22 having a flange 22'.

Experimental tests have demonstrated the result that one embodiment B of the apparatus according to the invention shown in FIG. 2 and another preferred embodiment C of the apparatus according to the invention shown in FIG. 9 are far superior in effect if compared with the conventional apparatus A shown in FIG. 1.

The shock sound levels produced from the conventional apparatus A and from the apparatuses B and C according to the invention were compared with each other on the basis of "Method of measuring floor shock sound level at the existing site in buildings" defined by JIS-A-1419. If the floor shock sound is produded by striking a hammer head of a tapping machine against the floor plate, the hammer head consists of a steel head. If the floor shock sound is produced by dropping a tire onto the floor plate, a tire having a size 5.20–10 and inflated by an internal pressure of 2 kg/cm$^2$ and having a weight of 7 kg was dropped from a height of 0.9±0.1 m onto the floor plate. The substrate was formed of concrete having a thickness of 120 mm.

The conventional apparatus A was constructed as shown in FIG. 1 and included the threaded rod 13 directly supported by the substrate 1 without using an elastic body. The floor plate 10 had a thickness of 30 mm and composed of a veneer board. The distance between the substrate 1 and the surface of the floor plate 10 was 140 mm.

The apparatus B according to the invention shown in FIG. 2 included the threaded rod 28 provided at its lower end with the cylindrical rubber-like elastic body 23 having a hardness defined by JIS of 80°. The thickness and material of the floor plate 20 and the distance between the substrate 1 and the surface of the floor plate 20 were the same as those of the conventional apparatus A.

The apparatus C according to the invention was constructed as shown in FIG. 9 and included an upper rubber-like elastic body 34 having a hardness defined by JIS of 70° and a lower rubber-like elastic body 23 having a hardness defined by JIS of 80°. The upper layer of the floor plate 20 had a thickness of 30 mm, the lower layer thereof had a thickness of 20 mm and a polyisobutylene rubber sheet 33 sandwiched between the upper and lower layers had a thickness of 1 mm. The other construction was the same as that of the apparatus B shown in FIG. 2.

Figure 10:
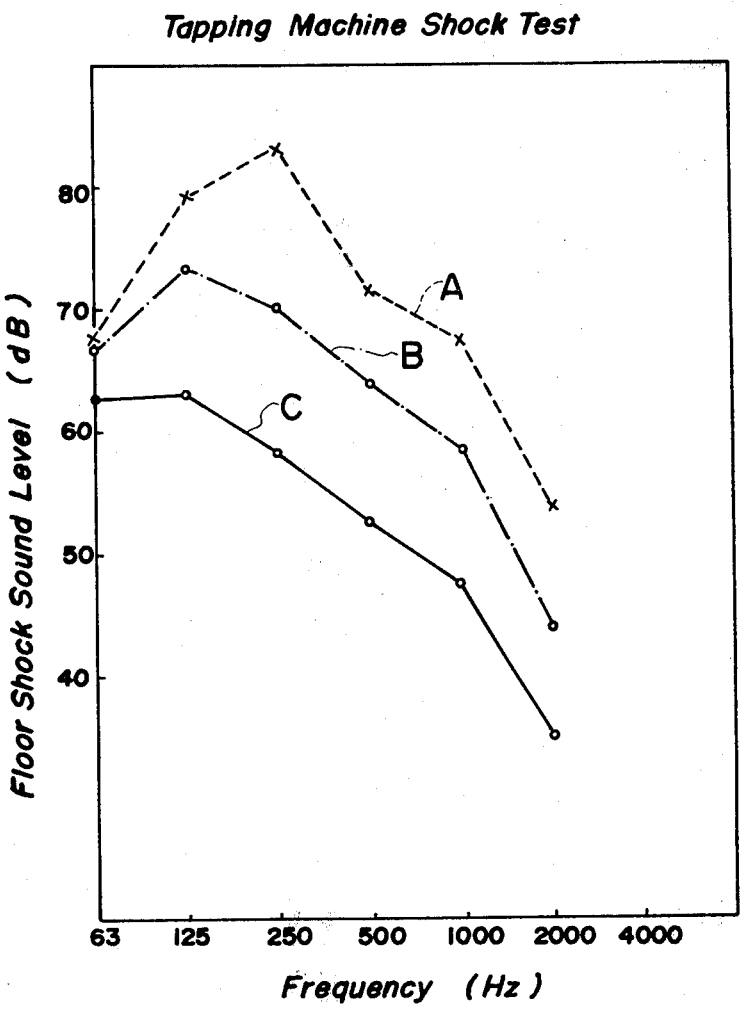
FIG. 10 is a graph showing floor shock sound levels in dB as a function of frequency in Hz resulted from tapping machine shock test.

FIG. 10 shows the measurement test result of the floor shock sound level produced when the hammer head of the tapping machine was struck against the floor plate. As seen from the test result as shown by dotted line curve A in FIG. 10, the conventional apparatus A which makes use of the threaded rod only produced very high shock sound below the floor. On the contrary, the floor shock sound level was considerably reduced by the apparatus B according to the invention which makes use of the threaded rod provided at its lower end with the rubber-like elastic body as shown by a dot and dash line curve B. On the one hand, the apparatus C according to the invention which makes use of the shock absorbing sheet sandwiched between the upper and lower layers of the floor plate and the threaded rod provided at its upper and lower ends with the rubber-like elastic bodies, respectively, can significantly reduce the shock sound level as shown by a full line curve C.

Figure 11:
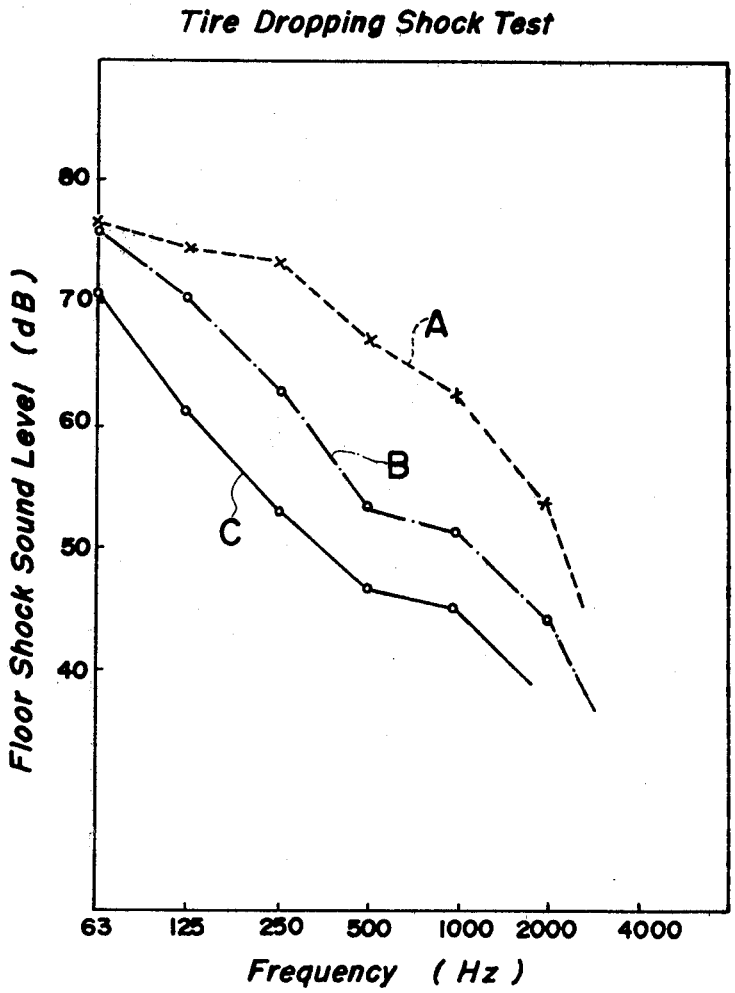
FIG. 11 is a graph showing floor shock sound levels in dB as a function of frequency in Hz resulted from tire dropping shock test.

FIG. 11 shows the measurement test result of floor shock sound level produced when the tire was dropped onto the floor plate. Similar to the case shown in FIG. 10, the floor shock sound level was significantly reduced by the apparatuses B and C according to the invention shown by a dot and dash line curve B and full line curve C, respectively, if compared with the conventional apparatus A shown by a dotted lines curve A.

As stated hereinbefore, the apparatus for supporting the floor plates above the substrate according to the invention is capable of not only simplifying a floor framework and its assembling operation but also widening an adjustable range between the upper and lower heights of the floor plate. In addition, the use of the rubber-like elastic body applied to the lower portion of the apparatus provides the important advantage that shocks or the like produced on the floor plate can be absorbed and shock sound produced when the floor is subjected to the load can be prevented. Thus, the apparatus according to the invention contributes greatly to various kinds of fields.

In addition, in the apparatus according to the invention, gas piping, city water and drain pipings may be arranged in a space formed between the substrate formed of mortar or the like and the floor plate surface without giving any special consideration to such arrangement. Eventually, a suitable casing enclosing such pipings may be installed within the space.

What is claimed is:

1. An apparatus for supporting floor plates above a substrate, comprising: a flat square floor plate provided at least at each corner thereof with a hole, an upper female screw threaded sleeve fitted in said hole of said floor plate, a cylindrical rubber-like elastic body having a center hole and disposed on the substrate, a lower female screw threaded sleeve fitted in said center hole of said cylindrical rubber-like elastic body and having threads oppositely handed to those of said upper female screw threaded sleeve, a supporting rod composed of a screw threaded rod provided at its upper and lower portions with right-handed and left-handed screw threads and at its upper end with a slot adapted to be engaged with and rotated by a driving tool, said right-handed and left-handed screw threads of said threaded rod being threadedly engaged with said upper and lower female screw threads of said upper and lower female screw threaded sleeves, respectively, and an annular rubber-like elastic body composed of an upper reduced diameter portion and a lower enlarged diameter portion and having a center bore extending through said upper and lower portions, said upper female screw threaded sleeve being fitted in said center bore of said elastic body.

* * * * *